United States Patent [19]

Hazelett et al.

[11] Patent Number: 4,537,243

[45] Date of Patent: Aug. 27, 1985

[54] METHOD OF AND APPARATUS FOR STEAM PREHEATING ENDLESS FLEXIBLE CASTING BELT

[75] Inventors: Robert W. Hazelett, Winooski; John F. B. Wood, Burlington, both of Vt.

[73] Assignee: Hazelett Strip-Casting Corporation, Malletts Bay, Vt.

[21] Appl. No.: 550,253

[22] Filed: Nov. 9, 1983

Related U.S. Application Data

[63] Continuation of Ser. No. 199,619, Oct. 22, 1980, abandoned.

[51] Int. Cl.[3] ..... B22D 27/02

[52] U.S. Cl. ..... 164/481; 164/433; 164/443

[58] Field of Search ..... 164/485, 481, 482, 430, 164/431, 432, 433, 443

[56] References Cited

U.S. PATENT DOCUMENTS

| | | | |
|---|---|---|---|
| 2,640,235 | 6/1953 | Hazelett | 164/432 |
| 2,904,860 | 9/1959 | Hazelett | 164/431 X |
| 3,036,348 | 5/1962 | Hazelett et al. | 164/431 X |
| 3,041,686 | 7/1962 | Hazelett et al. | 164/443 X |
| 3,123,874 | 3/1964 | Hazelett et al. | 164/431 |
| 3,142,873 | 8/1964 | Hazelett et al. | 164/431 |
| 3,167,830 | 2/1965 | Hazelett et al. | 164/431 |
| 3,228,072 | 1/1966 | Hazelett et al. | 164/431 |
| 3,310,849 | 3/1967 | Hazelett et al. | 164/431 |
| 3,429,363 | 2/1969 | Hazelett et al. | 164/433 X |
| 3,533,463 | 10/1970 | Hazelett et al. | 164/433 |
| 3,596,702 | 8/1971 | Ward et al. | 164/485 X |
| 3,785,428 | 1/1974 | Hazelett et al. | 164/433 |
| 3,828,841 | 8/1974 | Hazelett et al. | 164/443 |
| 3,848,658 | 11/1974 | Hazelett et al. | 164/431 |
| 3,864,973 | 2/1975 | Petry | 164/455 |
| 3,865,176 | 2/1975 | Dompas et al. | 164/431 |
| 3,878,883 | 4/1975 | Hazelett et al. | 164/443 |
| 3,921,697 | 11/1975 | Petry | 164/455 |
| 3,937,270 | 2/1976 | Hazelett et al. | 164/485 X |
| 3,949,805 | 4/1976 | Hazelett et al. | 164/431 |
| 3,955,615 | 5/1976 | Dompas et al. | 164/431 |
| 3,963,068 | 6/1976 | Hazelett et al. | 164/431 |
| 4,002,197 | 1/1977 | Hazelett et al. | 164/431 |
| 4,062,235 | 12/1977 | Hazelett et al. | 164/455 X |
| 4,082,101 | 4/1978 | Hazelett et al. | 134/127 |
| 4,150,711 | 4/1979 | Hazelett et al. | 164/431 X |
| 4,155,396 | 5/1979 | Dompas et al. | 164/431 X |

*Primary Examiner*—Nicholas P. Godici
*Assistant Examiner*—J. Reed Batten, Jr.
*Attorney, Agent, or Firm*—Parmelee, Bollinger & Bramblett

[57] ABSTRACT

The casting belt is preheated with steam closely ahead of the entrance to the casting zone by providing wrap-around steam feed tubes having nozzles, such tubes being positioned in very deep circumferential grooves in input pulley or nip pulley which moves the casting belt into the input end of the casting zone. These circumferential grooves of the input or nip pulley also house wrap-around liquid coolant feed tubes for cooling the casting belt near the beginning of the casting zone. The wrap-around steam feed tubes also have radial ports positioned to direct steam toward the reverse side of the endless belt, with the port being spaced from the nozzle thereby providing a staged elevation of temperature in the flexible casting belt on the input or nip pulley, while the belt is in contact therewith before the belt reaches the casting zone. Elevating the temperature prior to the endless belt reaching the casting zone and then suddenly cooling the belt when the molten metal is applied thereto improves casting conditions in the operation of such thin, flexible casting belt and enhances and speeds up the casting process. There are several ways for preventing coolant water from cooling the steam header and tubes of the bottom nip pulley in a twin-belt machine.

29 Claims, 17 Drawing Figures

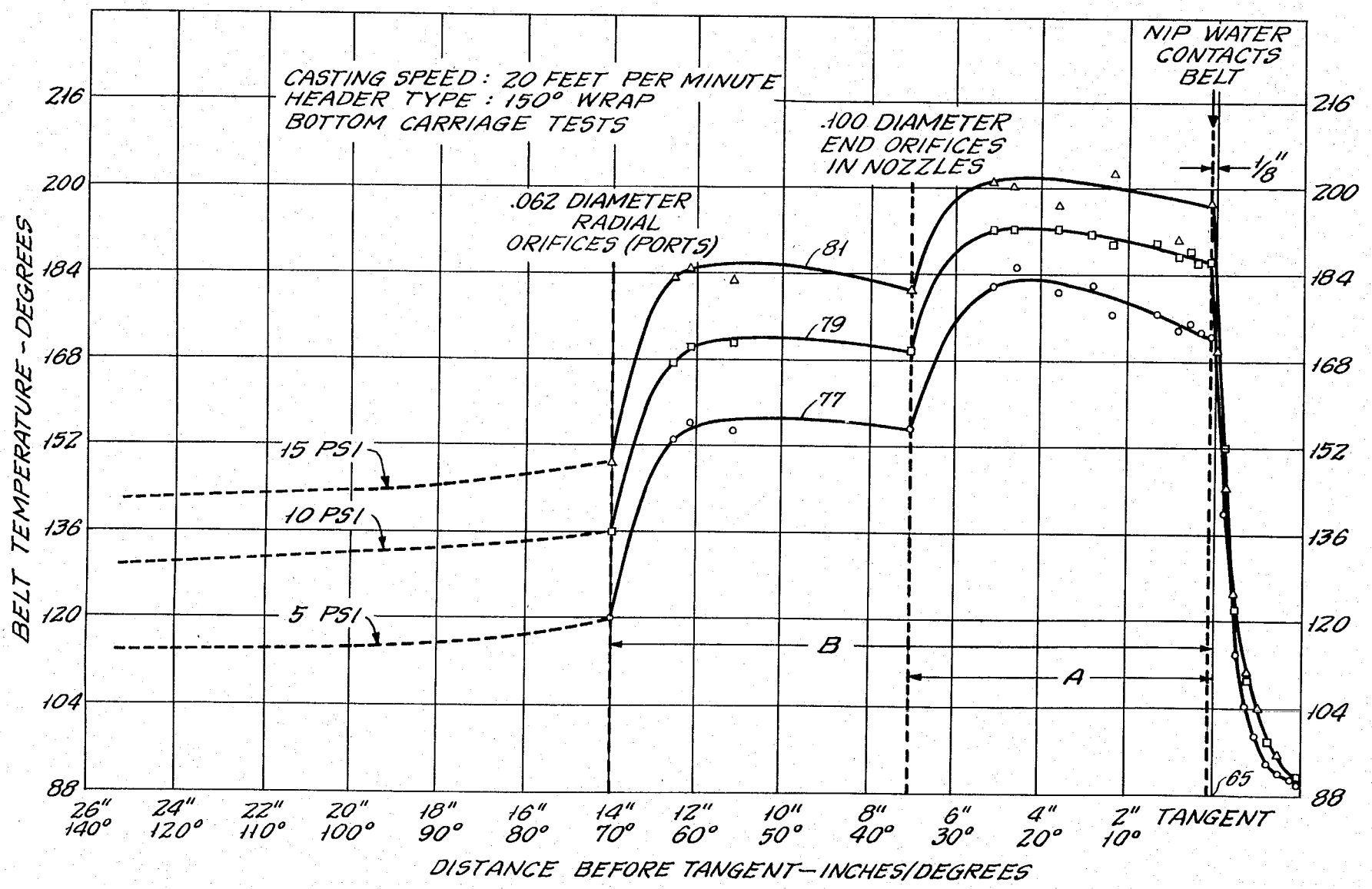
FIG. 6. BELT TEMPERATURE PROFILE VERSUS DISCHARGE PRESSURE IN STEAM SUPPLY HEADER

METHOD OF AND APPARATUS FOR STEAM PREHEATING ENDLESS FLEXIBLE CASTING BELT

This application is a continuation of application Ser. No. 199,619, filed Oct. 22, 1980 and now abandoned.

BACKGROUND OF THE INVENTION

This invention relates to an improved machine for continuously casting molten metal of the type having at least one thin, endless, flexible casting belt, such as in a twin-belt caster or wheel and belt caster, and more particularly to the method and apparatus for elevation of the temperature of the endless casting belt as it is revolved around the input pulley or nip roll (nip pulley) of the machine by applying steam directly to the reverse surface of the belt through wrap-around steam feed tubes with radial ports therein and a nozzle on one end thereof directing steam against the reverse side of the casting belt closely before it enters the casting zone from the input pulley.

U.S. Pat. No. 3,937,270 entitled "Twin-Belt Continuous Casting Method Providing Control of the Temperature Operating Conditions at the casting Belts" and U.S. Pat. No. 4,002,197 entitled "Continuous Casting Apparatus Wherein the Temperature of the Flexible Casting Belts in Twin-Belt Machines is Controllably Elevated Prior to Contact With the Molten Metal" by R. W. Hazelett and J. F. B. Wood which are assigned to the same assignee as the present application and divisional U.S. Pat. Nos. 4,062,235 and 4,082,101 describe twin-belt continuous casting machines in which the temperature of the flexible casting belts is controllably elevated prior to contact with the molten metal to improve the casting conditions in the operation of the twin, thin, flexible casting belts. The casting belts revolve around pulleys and pass along a casting zone from its input end to its output end with the input pulleys being referred to as the nip or input pulleys or nip rolls. The preheating of the casting belt is provided in the aforesaid patents by the use of infrared heaters which are directed at close range toward the casting surfaces of the belts. These heaters serve to cure and dry any coating material on the belts as well as preheating the belts to lessen the differential temperature that would result between a cold belt suddenly coming into contact with the hot molten metal which is to be cast against the traveling belt. Other methods of preheating the casting belt are also illustrated or mentioned which include heating of hollow nip rolls themselves by injecting hot fluid such as steam which is directed into the interior of the hollow nip roll or directing hot fluid, such as steam into deep grooves in the nip roll beneath the rear surfaces of the casting belts to aid in elevating and controlling their temperature. The difficulty with these procedures is that heating the nip rolls or directing steam into the deep grooves of the nip rolls dissipates a good deal of the heat generated by the steam and applies much of such heat to the input or nip pulley and not to the undersurface of the belt which is directly involved in the casting process. Furthermore, the control of the temperature of the belt relies more on the temperature of the input or nip pulley, and accordingly is not nearly so effective in controlling the actual differential temperature between the belt before and after it enters the casting zone. Moreover, the input or nip pulley is relatively massive and slow to respond in temperature changes; whereas quick response in belt preheating is required as the casting speed is increased during changes in operating conditions in a flexible belt casting machine.

SUMMARY OF THE INVENTION

It is an object of this invention to provide a new and improved method and apparatus for casting molten metal in which the thin, flexible, casting belt is uniformly and quickly preheated by direct application of steam to its reverse surface prior to its entry into the casting zone to control the differential in temperature of the belt before and after it enters the casting zone for speeding the casting process and enhancing the quality of the cast product.

A further object of this invention is to provide a new and improved method and apparatus for steam preheating by direct application of steam to the reverse side of a casting belt in flexible belt types of machines for casting molten metal, which reduces casting belt distortion and transverse buckling along the casting region near to and closely downstream from the contact of the molten metal onto the casting belt.

A still further object of the present invention is to provide a new and improved casting apparatus for preheating the casting belt from the reverse side before it enters a casting zone, which reduces the thermal shock to the belt and the coatings thereon and increases the operating life of the belt and the coatings and accordingly improves efficiency and increases the possible length of uninterrupted casting time between successive belt changes as well as enabling the machine to run faster while producing cast products of better quality.

In carrying out this invention in one illustrative embodiment thereof, apparatus for preheating the casting belt by direct application of steam to the reverse surface of the thin, flexible, casting belt is used in a machine for casting molten metal of the type wherein at least one endless casting belt revolves around pulleys and passes along a casting zone from its input end to its output end. An input pulley is provided for moving the casting belt into the input end of the casting zone. The input pulley has very deep circumferential grooves therein underlying the reverse side of the casting belt as the casting belt revolves around the pulley. A wrap-around steam feed tube having a nozzle on one end thereof is positioned in the very deep circumferential grooves of the pulley in order to apply steam directly from the nozzle to the reverse surface of the belt for heating the belt before the endless belt enters the casting zone, thereby reducing the differential temperature of the belt before and after it enters the casting zone to thereby reduce distortion enabling increasing the speed of the casting process and also increasing the life of the casting belt.

The wrap-around steam feed tube has a radial port positioned to direct steam impinging against the reverse side of the endless belt at a position in the circumferential groove of the input pulley spaced before the tube terminates in the nozzle.

The wrap-around steam feed tube is positioned in the same very deep circumferential groove which houses a wrap-around liquid coolant feed tube which serves to feed the coolant in a steam on the reverse side of the casting belt as it enters the casting zone.

Advantageously, this method and apparatus for elevating the temperature of the endless belt prior to its entry into the casting zone may be applied to twin-belt casters as well as to wheel and belt casters.

Several ways are provided for preventing the coolant from interfering with the heating function of the steam header and tubes for the lower input pulley in a twin-belt machine, and these apparatus may also be used in a wheel and belt machine for protecting the steam header and steam feed tubes from being struck by coolant.

BRIEF DESCRIPTION OF THE DRAWINGS

The invention, together with further objects, advantages and aspects thereof will be more clearly understood from a consideration of the following description taken in conjunction with the accompanying drawings in which like elements will bear the same reference numerals throughout the various FIGURES.

FIG. 6 is a belt temperature profile graph illustrating a plurality of plotted curves showing the temperature of a casting belt preheated in accordance with this illustrative embodiment of the present invention.

DETAILED DESCRIPTION OF THE PREFERRED EMBODIMENTS

Figure 1:
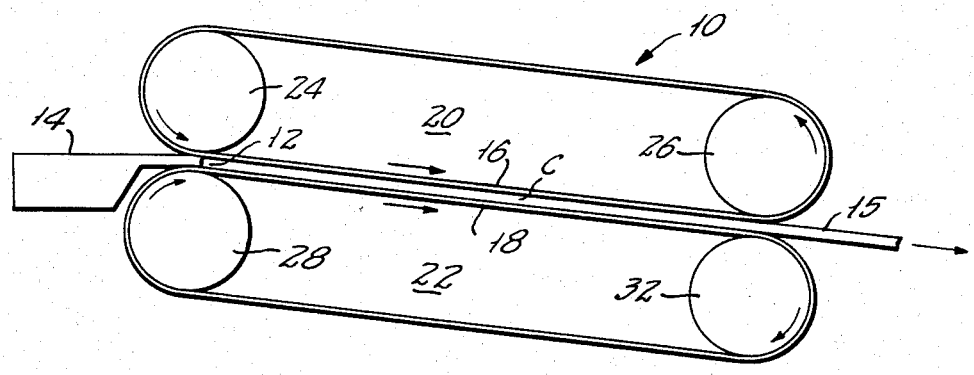
FIG. 1. PRIOR ART
FIG. 1 is a diagrammatic illustration of a twin-belt continuous casting machine in which the present invention may be applied to advantage.

The present invention relates to an improved method and apparatus for casting molten metal in a casting machine of the type which has at least one thin, endless, flexible casting belt, such as employed in twin-belt casters or wheel and belt casters. A twin-belt type of casting machine is illustrated schematically in FIG. 1 and is generally designated by the reference numeral 10. In the continuous casting machine 10 shown in FIG. 1, molten metal 12 is introduced from a tundish 14 positioned at the input end of the machine. The molten metal passes into a casting zone C defined between the spaced parallel front surfaces of a pair of wide, thin, endless, flexible casting belts 16 and 18. In operation, these belts are revolved around upper and lower belt carriages 20 and 22, respectively. The two sides or edges of the casting zone C are defined by a pair of laterally spaced, endless side dams (not shown) which travel between the upper and lower casting belts 16 and 18 in the casting zone and which revolve around the lower carriage 22 to complete their path of travel. Details of these as well as other features of such a twin-belt casting machine can be obtained by reference to the aforesaid patents.

The upper belt carriage 20 includes a pair of main pulleys or rolls 24 and 26 located at the upstream and downstream ends of the carriage. Similarly, the lower belt carriage 22 includes a pair of main pulleys or rolls 28 and 32 at its upstream and downstream ends. In the machine 10, the downstream or discharge pulleys 26 and 32 serve to tension and to steer the belts 16 and 18, while the upstream or input pulleys or rolls 24 and 28 define the entrance of "nip" region of the casting zone C and are used to drive the belts on their respective carriages. The input rolls 24 and 28 may also be referred to as nip rolls on pulleys. As the belts 16 and 18 are revolved on their pulleys they are cooled by coolant applied to their reverse surfaces along the casting zone C, and a continuous cast metal product 15, which may be a slab, plate, sheet, bar or strip, is discharged from the output end of the machine 10.

Figure 2:
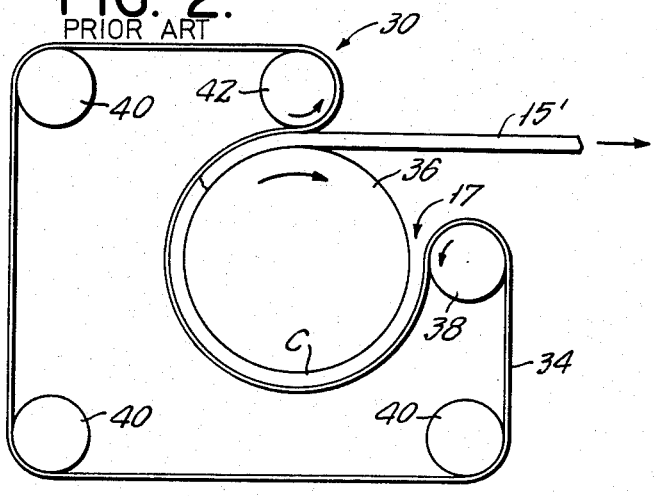
FIG. 2. PRIOR ART
FIG. 2 is a diagrammatic illustration of a wheel and belt continuous casting machine in which the present invention may be applied to advantage.

The other type of machine to which the present invention is applicable is a wheel and belt casting machine shown schematically in FIG. 2 and referred to generally by the reference number 30. The wheel and belt casting machine 30 employs a single endless belt 34 which is guided to be revolved around a wheel 36 by an input or nip pulley 38, a plurality of intermediate pulleys 40 and a discharge pulley 42. For further information about wheel and belt continuous casting machines (which may also be called "wheel-belt" machines) the reader is referred to U.S. Pat. No. 3,785,428 in the name of R. W. Hazelett, R. Hazelett and J. F. B. Wood, two of whom are the present inventors. The casting zone C in the wheel and belt casting machine 30 is formed between the wheel 36 and the endless belt 34 as it revolves between the input and discharge pulleys 38 and 42, respectively, with the cast product 15' being fed out from the output of the machine in the region between the discharge pulley 42 and the wheel 36. The molten metal is introduced into the entrance region as indicated by the arrow 17.

The outer surface of each casting belt in either type of machine which faces the casting zone C is called the front surface or face, while the surface facing inwardly toward the pulleys is called the reverse or rear surface or face. Such endless casting belts are made of relatively thin, sheet steel, and the front surface may have a finely roughened texture produced by sand blasting. A coating of thermal insulation material is often adhered to such a roughened front surface to protect the belt from the enormous heat flux to which it is subjected when molten metal is applied thereto from the entrance. As is discussed in the above patents, longitudinal tension is also maintained in each belt to minimize belt distortion adjacent to the casting region.

In accordance with U.S. Pat. Nos. 3,937,270 and 4,002,197 and the other two patents set forth in the introduction, in order to overcome the problem of distortion or transverse buckling downstream from the entrance to the casting zone, the temperature of the casting belts was elevated ahead of the entrance to the casting zone. Then, coolant was applied at high velocity to the reverse surfaces of the belts at locations coincident with the entrance to the casting region or very close to the entrance to the casting zone. Accordingly, the temperature profile of the belt both before and after it entered the casting zone was closely controlled.

The present invention involves the advantageous control of the temperature of such a flexible casting belt by the direct application of steam in stages to the reverse surface of the endless belt before it enters the casting zone and to the prevention of the coolant from interfering with the heat content of the steam before it is applied. We have found from experimental test runs employing the method and apparatus of the present invention that preheating the flexible casting belt by applying steam directly to the reverse surfaces of the belts, thereby producing rapid staged preheating improves the quality of the cast product (namely, continuously cast aluminum) dramatically as produced in a twin-belt machine while at the same time enables the speed of the casting machine to be significantly increased for significantly increasing the production of cast product being made by the machine. It is a synergistic effect of considerable importance that both the quality of the product and speed of production were increased by employing the method and apparatus of this invention. Moreover, the resultant speed of production was faster than any level heretofore attained in the particular production installation involved in these tests.

Figure 4:
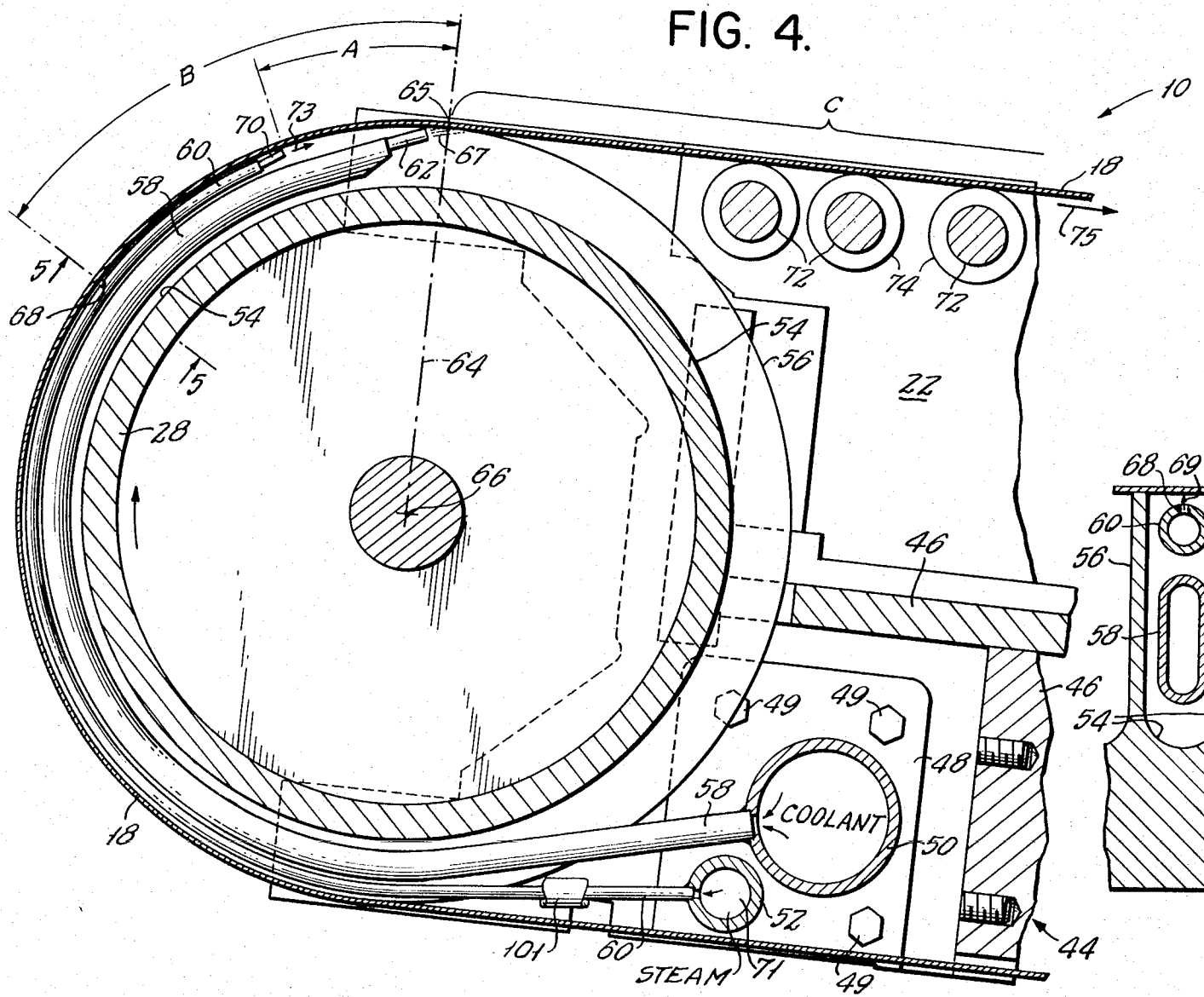
FIG. 4 is an elevational cross-sectional view of an input or nip pulley and neighboring components as employed in a twin-belt casting machine incorporating steam preheating plus water cooling in accordance with the present invention.

FIG. 4 illustrates the steam preheating of the belt in the twin-belt casting machine 10. The lower input or nip pulley 28 is shown mounted in the lower carriage 22 which includes a chassis 44 including carriage frame members 46. The lower carriage chassis 44 also carries a header mounting 48 secured by bolts 49 for supporting a liquid coolant supply header 50 and a steam supply header 52.

Figure 5:
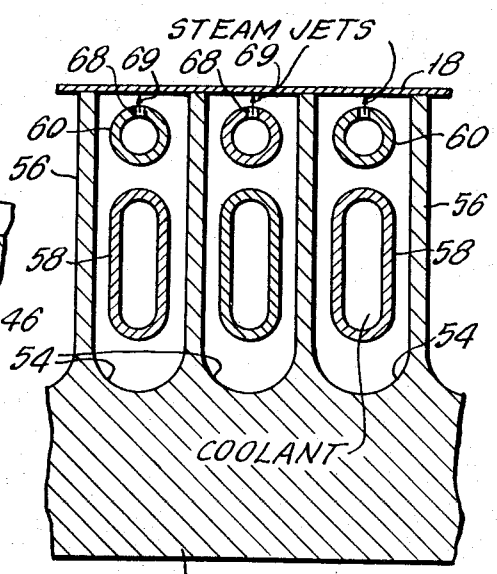
FIG. 5 is an enlarged sectional view taken along line 5—5 of FIG. 4 looking in a direction parallel with a tangent to the nip pulley.

As will best be seen in FIG. 5, this lower input pulley 28 has a plurality of very deep circumferential grooves 54 therein defining relatively narrow, annular, circumferential ridges 56 of relatively great radial extent. In other words, these are very tall and narrow ridges or fins 56 on the pulley 28 which contact the reverse surface of the revolving casting belt 18 as it travels partially around this pulley.

As shown in FIGS. 4 and 5 there are wrap-around coolant feed tubes 58 connected to the liquid coolant supply header 50, and there are also wrap-around steam feed tubes 60 connected to the steam supply header 52. These wrap-around coolant and stem feed tubes 58 and 60 are aligned with each other in pairs, with each coolant tube being nested down deep in the respective groove 54 and with each steam tube being bent on an arc of larger radius than the radius of the concentric arc of the companion coolant tube so that a steam tube is located radially outside of the coolant tube in each respective groove. Each coolant feed tube 58 is terminated in a nozzle 62 which is aimed toward the belt tangent point 65 at the periphery of the nip pulley 28. This tangent point 65 is the point where the flexible belt 18 straightens out and separates from the periphery of the tall, narrow ridges 56 as this belt enters the casting zone C.

In this casting machine 10, as seen in FIG. 1, the axes of the two input pulleys 24 and 28 are directly opposite to each other, and so an imaginary line 64 (FIG. 4) which connects the axis 66 of the lower input pulley 28 with the axis of the upper input pulley passes through the tangent point 65. The jet of coolant 67 issues at high velocity from each nozzle 62 and strikes the reverse surface of the belt 18 at a relatively small angle of incidence of less than 25°, causing the liquid coolant from these respective jets 67 to spread out over the reverse surface as a film of liquid coolant traveling at high velocity in the downstream direction along the belt in the casting zone C.

Each of the wrap-around stream feed tubes 60 has a radial port 68 therein preceding the termination of the stream tube in a nozzle 70 which directs a jet 69 (FIG. 5) of the steam directly perpendicular toward the reverse surface of the belt 18 at an angular distance "B" prior to the tangent point 65. Accordingly, each radial steam port 68 causes a jet of steam 69 to impinge perpendicularly against the reverse surface of the casting belt for producing a relatively sudden first stage of temperature elevation of the belt, as will be explained further in connection with FIG. 6.

The steam 71 is supplied under pressure in the header 52, for example at a pressure in the range from 5 to 20 pounds per square inch (p.s.i.) above atmospheric pressure. The upper portion of this range is the preferred pressure level, for as is seen in FIG. 6 a supply pressure level of 15 p.s.i. is considerably more effective than 5 p.s.i. in producing the desired first stage of elevation of the belt temperature. In other words, at least 5 p.s.i. is needed and the preferred steam supply pressure level at 71 is 10 p.s.i., while optimum is approximately 15 to 20 p.s.i. for casting aluminum. The curves in FIG. 6 are for saturated steam.

When casting metal product 15 and 15' having a higher melting temperature, for example copper, then the steam supply 71 may advantageously be superheated in the range from 200° F. to 600° F. above the temperature of the saturated steam.

The radial ports 68 in the steam tubes 60 are located at an angular distance in the range from 45° to 90° before the tangent point 65. If this angle B is increased much beyond 90° then this first stage of preheating loses effectiveness because the belt begins to cool off unduly. On the other hand if this angle B is decreased below 45° then this first stage of preheating does not have sufficient time to reach its full effectiveness. Then, the nozzle 70 at the end of the steam feed tube 60 directs a larger quantity of steam in a jet 73 at a very small angle of incidence of less than 10°. In this example as shown in FIG. 4, the steam jet 73 from the nozzle 70 is impinging against the reverse surface of the belt at nearly grazing incidence. This nozzle jet of steam 73 further elevates the temperature of the casting belt prior to the tangent point 65, where the belt enters the casting zone C.

The steam nozzle 70 is positioned at an angular distance "A" before the tangent point 65 in the range from 20° to 45° with the radial steam orifice 68° being positioned at least 20° before the nozzle. In other words, the minimum value of B-A is at least approximately 20°. In this example the angular distances A and B are approximately 35° and 70°, respectively, as seen also in FIG. 6.

Accordingly, the temperature of the casting belt is rapidly elevated in two stages ahead of the tangent point 65, and the application of coolant from the nozzle 62 to the reverse surface of the casting belt 18 is sharply defined and precisely controlled to coincide closely with the application of molten metal against the front surface of this belt.

This two-stage preheating by direct steam application to the reverse surface of the casting belt dramatically improves performance as to both product quality and casting speed by substantially overcoming the problem of distortion or transverse buckling closely downstream from the tangent point 65, where the molten metal 12 is hottest and first encounters the casting belt.

As shown in FIG. 4 there are a plurality of belt backup rollers 72 having fins 74 for supporting and guiding the casting belt traveling downstream along the casting zone C as shown by the arrow 75. The fins 74 on these backup rollers 72 allow the coolant film (not shown) to continue traveling at high velocity and to be partially scooped off and replenished with more high velocity coolant applied at predetermined locations to the reverse surface of the casting belt along the casting zone C as is known in the twin-belt casting machine art.

FIG. 6 illustrates the belt temperature profile in distance before the tangent point 65 as measured in both inches and degrees for three different values of discharge pressure in the steam supply header 52 as measured at 71 (FIG. 4). Saturated steam was used for the tests in FIG. 6, and no molten metal was present. The pulley 28 in this example had a diameter of approximately two feet so that an angular distance of 90° corresponds closely with a circumferential distance of 18 inches. As will be observed from the three respective plotted curves 77, 79 and 81, as the belt reaches the radial orifice or port 68 in the wrap-around steam tube 60, its temperature is elevated rapidly and then decreases slightly until the end orifice or steam nozzle 70 is reached, at which time the temperature is again sharply elevated in advance of the tangent point 65.

In this example as plotted in FIG. 6 the high velocity coolant jet 67 initially contacts the rear of the belt at a point ⅛th of an inch before the tangent point 65. These coolant jets are collectively referred to as "Nip Water" in FIG. 6. As soon as this coolant water strikes the belt in the absence of molten metal, then the belt is cooled rapidly as shown by the steep slope of the plots 77, 79 and 81. It will be observed that the higher the steam pressure at 71 in the supply header 52 the greater is the elevation in belt temperature. It will also be observed that what is achieved is a very controllable casting belt temperature rapidly elevated in two stages which minimizes or eliminates distortion of the casting belt and increases the life of such belts as well as enabling increases in the speed of the casting process and producing an improved product.

The legends on FIG. 6 show that the steam nozzles 70 each had orifice diameters of 0.100 of an inch, while the radial discharge ports 68 each had a diameter of 0.062 of an inch. Thus, the cross sectional area of each nozzle orifice was 2.6 times the cross sectional area of each radial discharge port for allowing almost three times as much steam to be provided in the nozzle jets 67 as compared with the radial jets 69, because these nozzle jets provide the second stage of temperature elevation, which may be considered the final "boost" in belt temperature. For this final boost in temperature considerably more heat energy is needed than for the first stage of preheating.

The legend "Casting Speed" means that the belt is traveling at a velocity of 20 feet per minute. The legend "150° Wrap" means that steam nozzles 60 are curved through an arc of that length concentric about the axis 66 of the input pulley 28.

Figure 3:
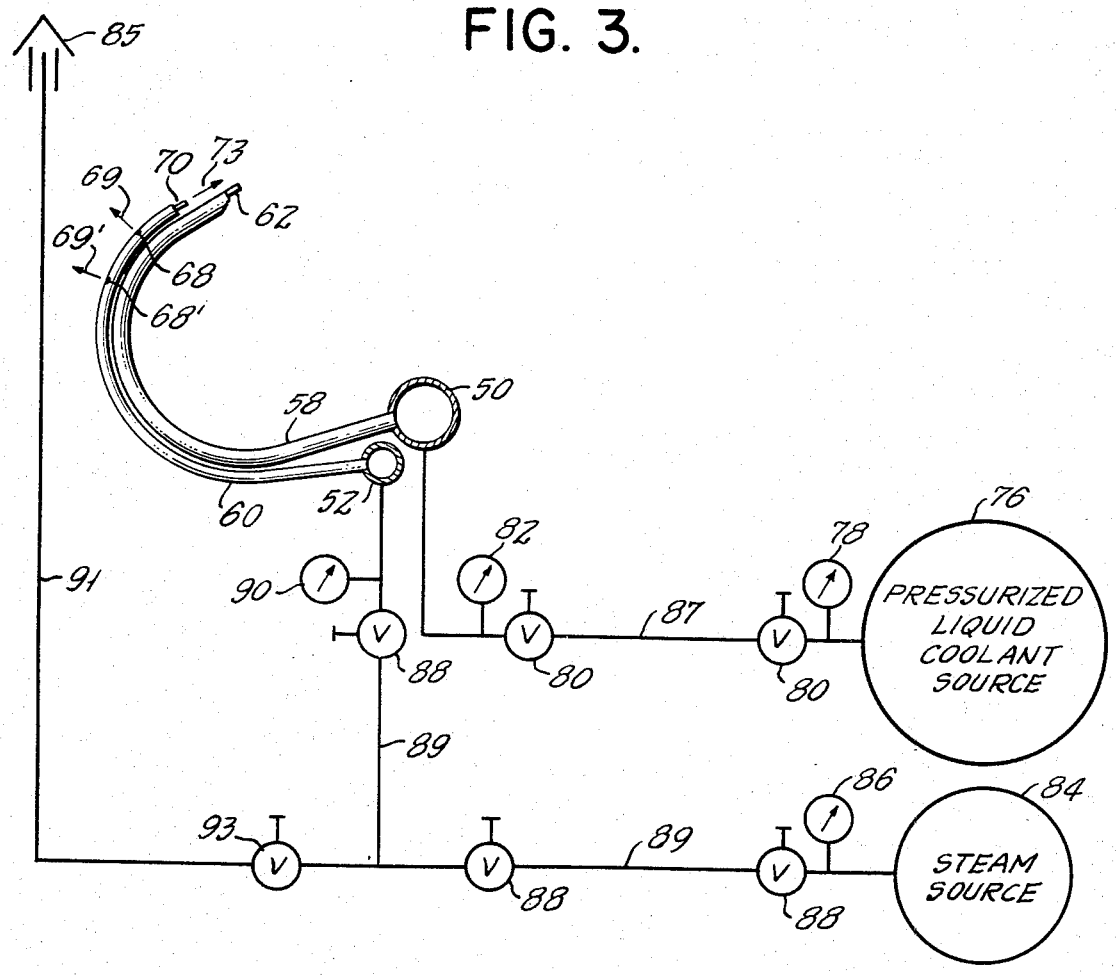
FIG. 3 is a schematic diagram of a steam preheating system and water coolant system which are cooperatively utilized in one embodiment of the present invention.

Turning attention to FIG. 3, there is illustrated a steam preheating and coolant system which is utilized with this embodiment of the present invention. The system includes a pressurized liquid coolant source 76, for example water containing corrosion inhibitors and which is under pressure from the action of a powerful centrifugal type of pump. This coolant source 76 feeds through a line 87 connected to a source pressure gauge 78 and containing a plurality of shut-off valves 80 and a supply pressure gauge 82 adjacent to the liquid coolant header 50, which supplies a plurality of wrap-around coolant feed tubes 58 nestled in the deep circumferential grooves 54 of the nip pulley 28 as described above. A pressurized steam source 84, for example a Bryan Steam Boiler (gas-fired, oil-fired, or dual fired) from Bryan Steam Corporation of Peru, Indiana, is connected via a line 89 to a source pressure gauge 86. The steam line 89 contains a plurality of steam shut-off valves 88, and there is a supply pressure gauge 90 adjacent to the steam header 52. This steam header 52 supplies a plurality of steam feed tubes 60 as described above. The steam line 89 to the header 52 is also connected through a discharge shut-off valve 93 to a discharge line 91 running up a roof outlet vent 85 for discharging excess steam.

Figure 7:
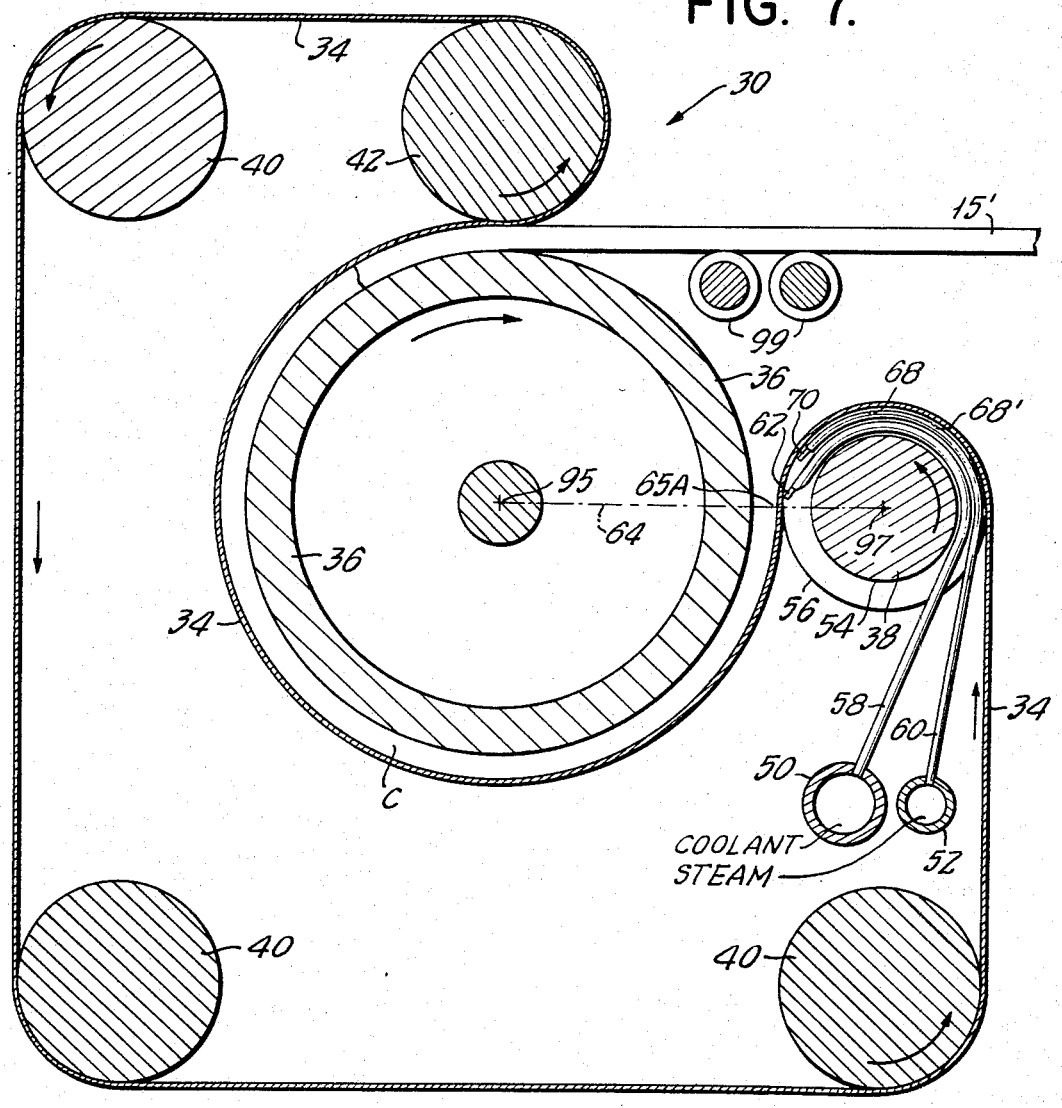
FIG. 7 is an elevational cross-sectional view of the casting wheel and belt with its pulleys in a wheel and belt type of casting machine incorporating the steam preheating plus water cooling apparatus in accordance with a second embodiment of the present invention.

FIG. 7 illustrates the use of wrap-around steam tubes 60 and wrap-around coolant feed tubes 58 in a wheel-belt casting machine 30, as briefly discussed with reference to FIG. 2. The steam feed tubes 60 and coolant feed tubes 58 are nestled in juxtaposition in the very deep circumferential grooves 54 of the input or nip pulley 38 of the casting machine 30 for providing similar advantageous belt temperature control and preheating as illustrated in connection with the twin-belt machine of FIG. 4. A difference in this embodiment is that a single belt 34 is utilized, and therefore only a single pulley 38 houses the nesting coolant and steam feed tubes. Moreover, another difference is that the belt 34 is curved around the perimeter of the wheel 36 downstream from the point 65A, thereby defining a large diameter cylindrical configuration, whereas in FIG. 4 the belt 18 has a planar configuration downstream from the point 65. The purposes of this staged, steam belt preheating system in FIG. 7 are the same as those which have already been described.

It is noted that the point 65A is the belt curvature inflection point where the flexible belt 34 separates from the fins 56 on the input pulley 38 and commences traveling around the wheel 36. This point 65A is located on an imaginary line 64 passing through the axis 95 of the wheel 36 and also through the axis 97 of the input pulley 38. For conveying the cast product 15' away from the wheel-belt machine 30 there are take-away rollers 99.

Figure 8:
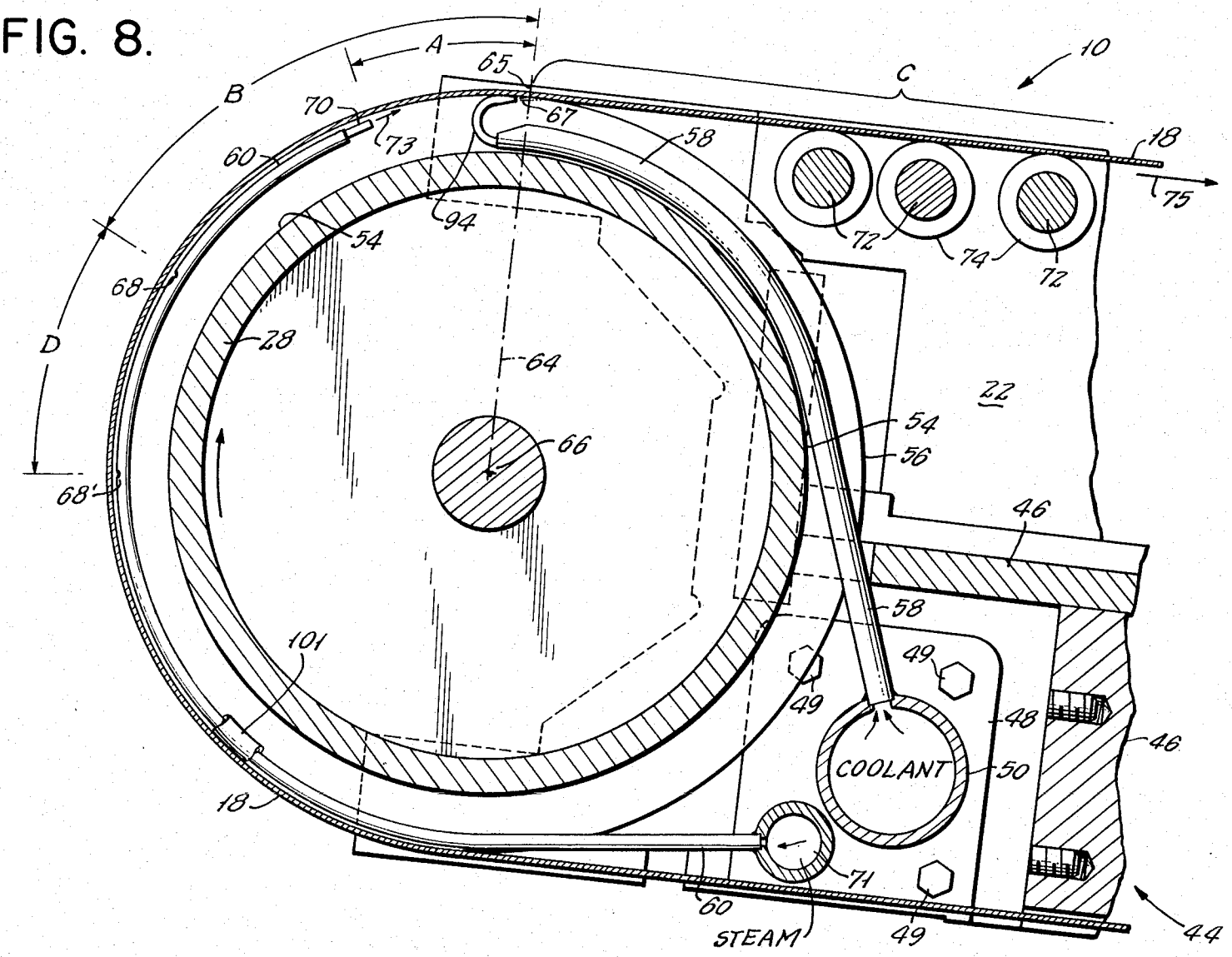
FIG. 8 is an elevational cross-sectional view similar to FIG. 4, illustrating a modified embodiment of the method and apparatus shown in FIG. 4.

FIG. 8 illustrates a modification of the embodiment of FIG. 4 in that the steam feed tube 60 and coolant feed tube 58 are no longer in concentric juxtaposition within the deep circumferential grooves 54 of the nip pulley 28, but are wrapped-around opposite sides of the input pulley 28 in the circumferential grooves, with the coolant tubes 58 each terminating a hook type of nozzle 94 for providing the coolant jet 67 directed downstream near the belt tangent point 65.

Among the advantages of having the coolant feed tubes curving around the opposite side of the input pulley from the steam feed tubes are those resulting from the fact that more room in the deep grooves 54 becomes available for the steam tubes. Thus, the steam tubes 60 may be insulated as shown by the thermal insulation coating at 101. Such thermal insulation 101 may extend for the full length of the steam feed tubes 60 or may extend only for a portion of their length. Also, these steam tubes 60 may be ovalized for providing more steam flow capacity through them, and a third stage of preheating may be provided by a jet 69' (FIG. 3) of steam from a radial discharge port 68' at an angle D (FIG. 8) before the port 68. This angle D is approximately equal to B-A. Namely, the port 68' is approximately the same angular distance ahead of the port 68 as the latter port is ahead of the nozzle 70. Moreover, by separating the steam and coolant feed tubes there is less tendency for heat transfer to occur between the hot steam and the coolant liquid, which is approximately at room temperature when it is initially introduced into the coolant header 50.

It is noted that in FIG. 4 such a third stage of steam preheating may be provided, if desired, by a radial discharge port 68' at an angular distance D ahead of the port 68.

Figure 9:
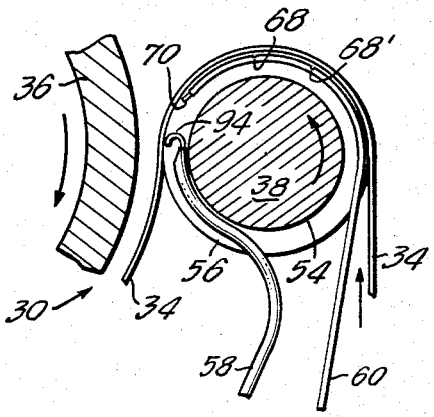
FIG. 9 is a partial elevational sectional view, similar to a portion of FIG. 7, illustrating a modified embodiment of the method and apparatus shown in FIG. 7.

With respect to the coolant hook nozzle embodiment (also called the reverse-wrap embodiment) shown in FIG. 8, a similar reverse-wrap coolant tube embodiment and oppositely disposed steam feed tube arrangement is shown in FIG. 9 incorporated in the wheel-belt casting machine 30 of FIG. 7. A benefit of this arrangement is to isolate the coolant and steam tubes so that the steam is not cooled before being applied to the belt. Although insulated steam feed tubes may be employed, it may be desirable to separate these different feed tubes whose temperature functions are diametrically in opposition.

In order to obtain the full benefit of staged steam preheating of the belt on the bottom carriage of a twin-belt machine, the action of the coolant water after being applied to the reverse surface of the belt must be controlled with respect to: (a) its directly falling onto the steam header and steam tubes, and (b) with respect to its being deposited on and following along the surfaces of the very deep circumferential grooves 54 in the nip pulley and thereby coming into contact with the steam tubes and header. The intent is to use the coolant for controlling the belt temperature in the casting zone C and not to lower the temperature of the steam before the steam is applied to the reverse surface of the belt.

Figure 10:
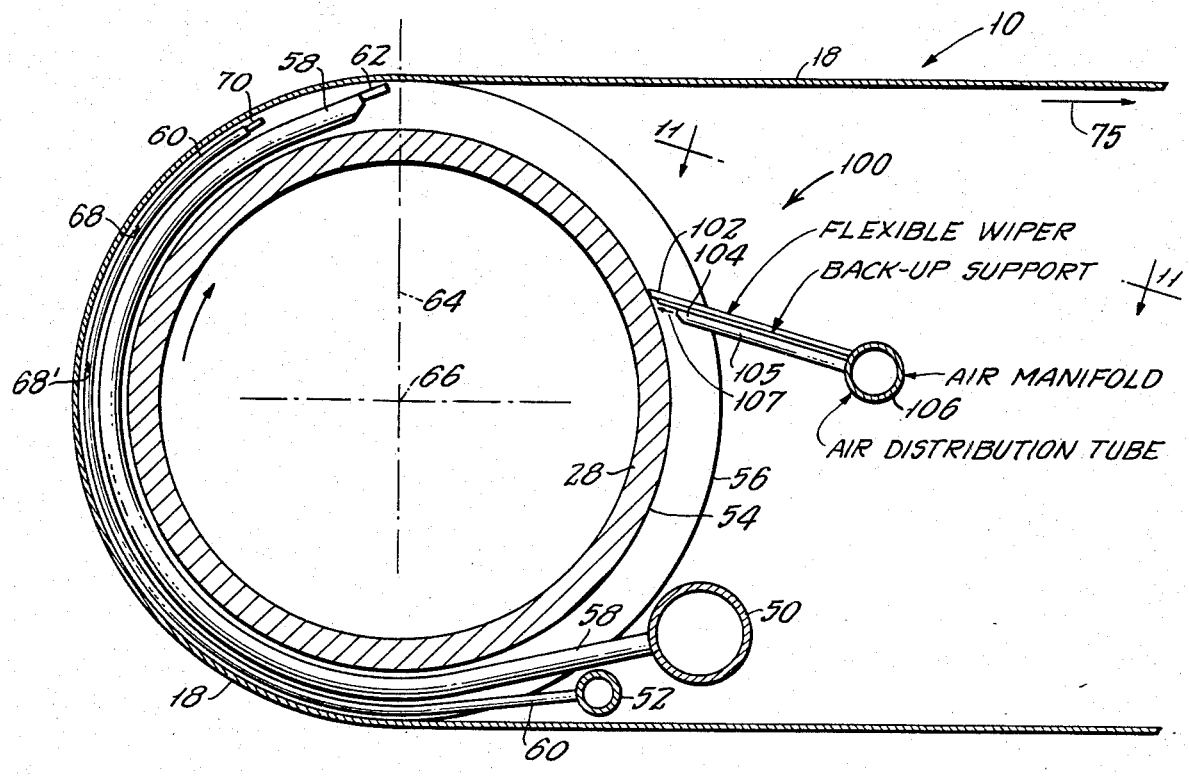
FIG. 10 is a cross-sectional view of an input or nip pulley similar to the showing in FIG. 4 illustrating one type of flexible wipe shield apparatus which may be employed in various embodiments of the present invention.
Figure 11:
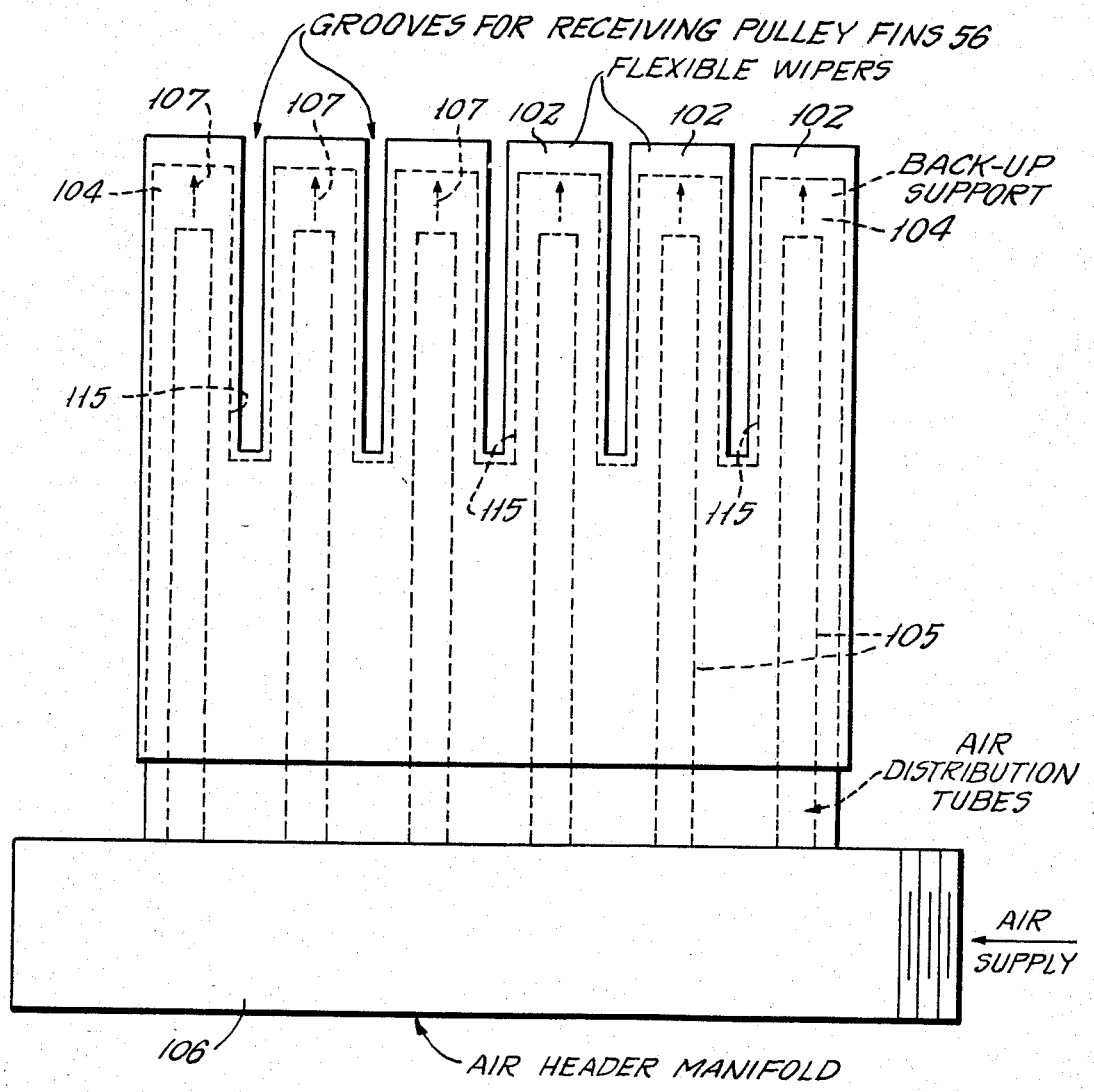
FIG. 11 is an enlarged top view of such flexible wipe shield structure as seen from the direction 11—11 in FIG. 10.

FIG. 10 illustrates one embodiment of a flexible wipe shield arrangement 100 for subsequently controlling the coolant water which has been applied from the nozzle 62 to the reverse surface of the belt 18. In this embodiment a flexible finger-shaped wipe blade 102 is closely fitted to the profile of each of the very circumferential grooves 54 in the nip pulley 28, as seen also in FIG. 11. The assembly 100 of these wiper blades 102 is positioned above the steam header 52 and tubes 60 in the manner of a roof for preventing coolant water from falling directly thereon. Each of the pliable blades 102 has a rigid backup support 104 and an air distribution tube 105 all mounted on an air supply header 106, as shown in FIGS. 10 and 11. These blades 102 themselves wipe coolant from the grooves 54. The blast of air 107 from the end of each of the air distribution tubes 105 assists in removing water from the underside of the finger-shaped wiper blades 102.

Figure 12:
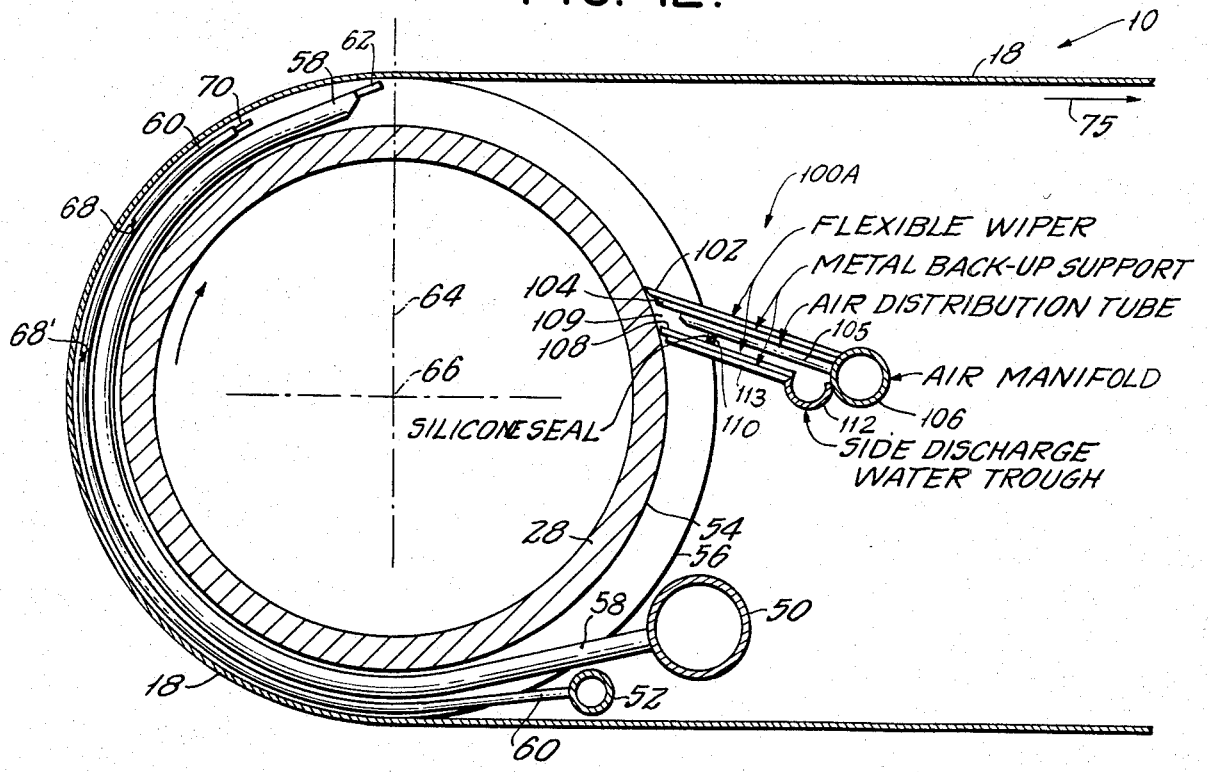
FIG. 12 illustrates another embodiment of the flexible wipe shield apparatus which may be employed in various embodiments of the invention.

In FIG. 12 a variation of the embodiment of FIGS. 10 and 11 uses a two-stage wiper shield assembly 100A in which there is a second flexible fingered shield 108 positioned by a silicone seal 110 in a location closely spaced below the air distribution tubes 104 to create a confined region 109 between the two spaced parallel wipers 102 and 108 and between the pulley 28 and the silicone seal 110 between the wiper shields 102 and 108 to collect water deposited therein as a result of the air blasts and the action of these two wiper shields. The trough 112 has a forwardly extending ledge 113 which serves as a rigid support for the set of flexible wiper blades 108 in a manner similar to the way in which the rigid plate 104 supports the other set of flexible wiper blades 102. It is to be understood that each of these support blades 104 and 113 have slots 115 (FIG. 11) in them for providing clearance for receiving the fins 56 of the pulley. These slots 115 are somewhat wider than the aligned clearance grooves in the respective wipers as will be understood from FIG. 11.

This arrangement of FIG. 12 requires less air flow than the system described in connection with FIG. 10 and also more precisely controls the air flow in the region 109 for preventing any high velocity air from inadvertently disturbing the coolant flow from the nozzles 62.

Figure 13:
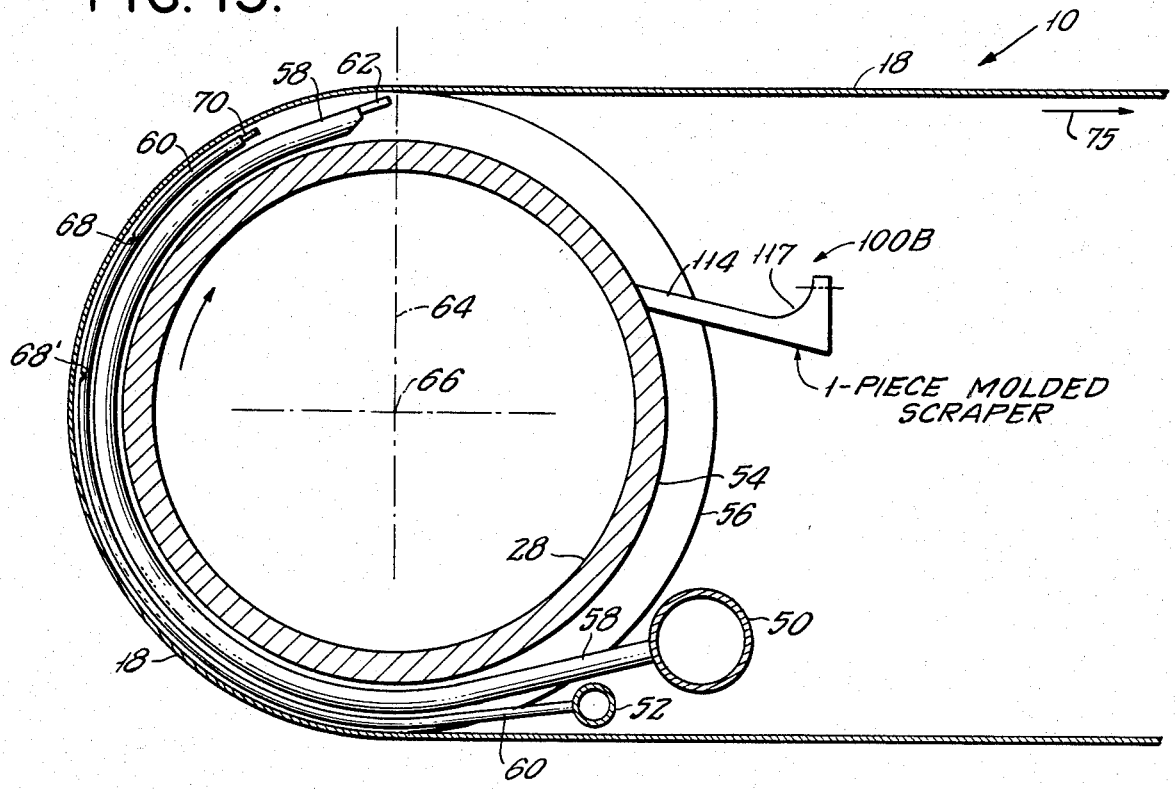
FIG. 13 illustrates the use of a one-piece molded scraper for the flexible wipe shield apparatus.

In the wiper arrangement 100B as shown in FIG. 13 a unitary, stiffly resilient single-piece finger-shaped molded stiff rubber scraper 114 is provided having a slotted configuration which conforms to the configuration of the very deep circumferential grooves 54 in the nip roll 28. This wiper structure 114 is positioned above the steam header 52 and steam tubes 60 like a roof for preventing water from falling directly thereon and which channels the coolant away by itself in an integral gutter or trough 117.

Figure 14:
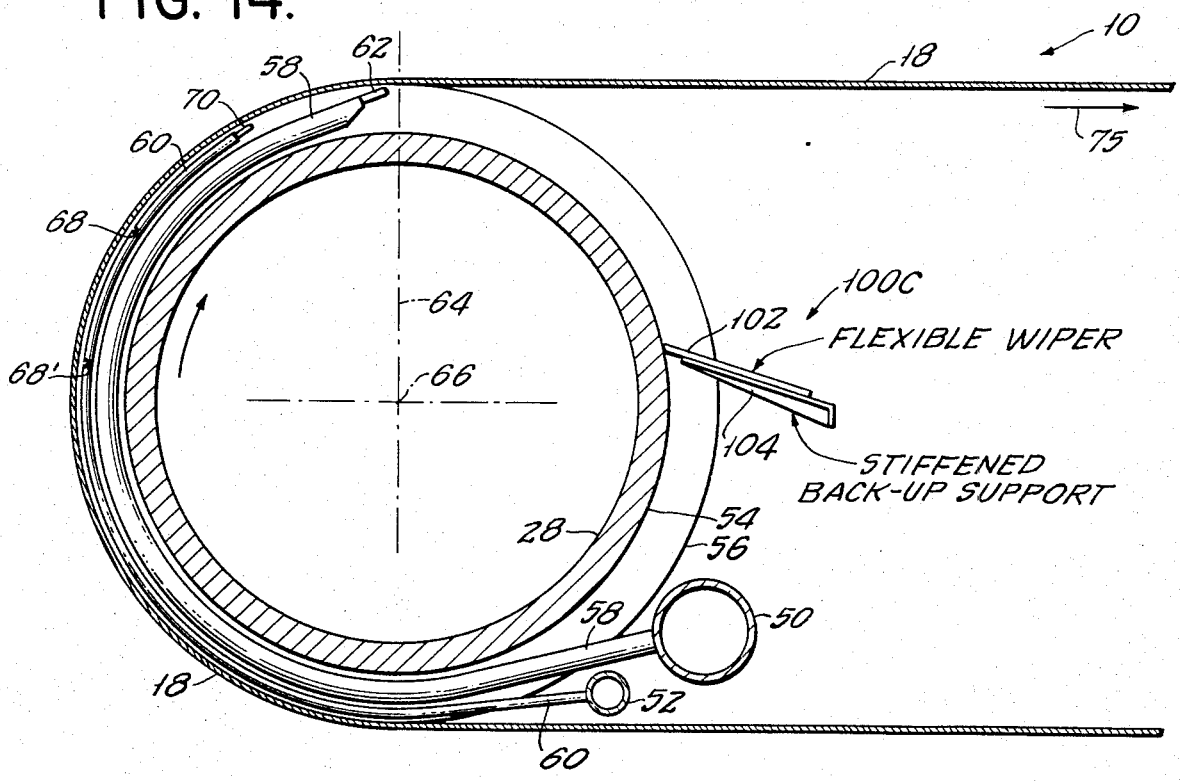
FIG. 14 illustrates another flexible wipe shield structure which may be employed in the various embodiments of the present invention.

In the wiper arrangement 100C shown in the embodiment of FIG. 14 similar functions are performed by a set of flexible wiper blades 102 which is mounted on a rigid backup support 104, these blades and the support are slotted similar to the slotting shown in FIG. 11 for receiving the pulley fins 56.

It is to be understood that the wiper arrangements 100, 100A, 100B and 100C of FIGS. 10–14 can also be employed with a wheel-belt machine as shown in FIG. 7 for protecting the steam header 52 and steam tubes 60 from the liquid coolant.

Figure 15:
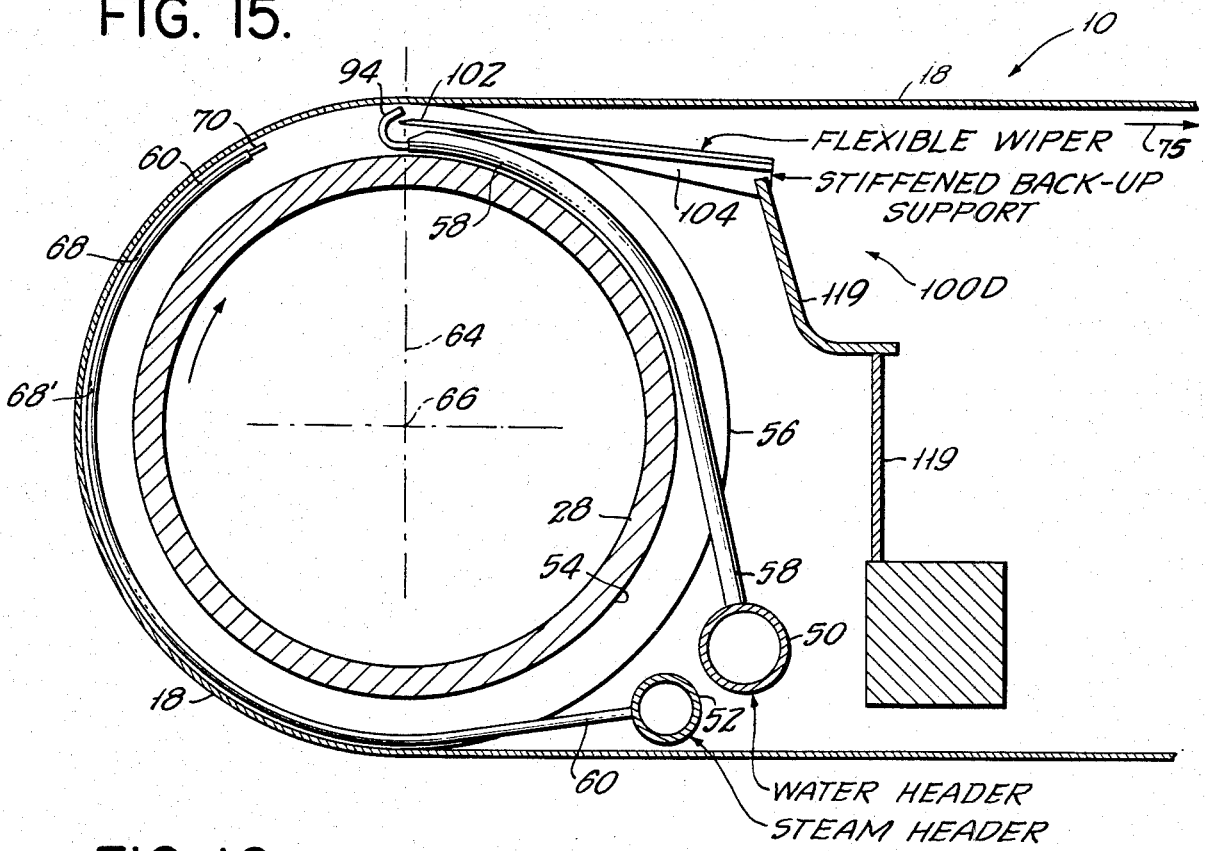
FIG. 15 illustrates one type of flexible wipe shield structure for use with the hook nozzle embodiment of FIG. 8.
Figure 16:
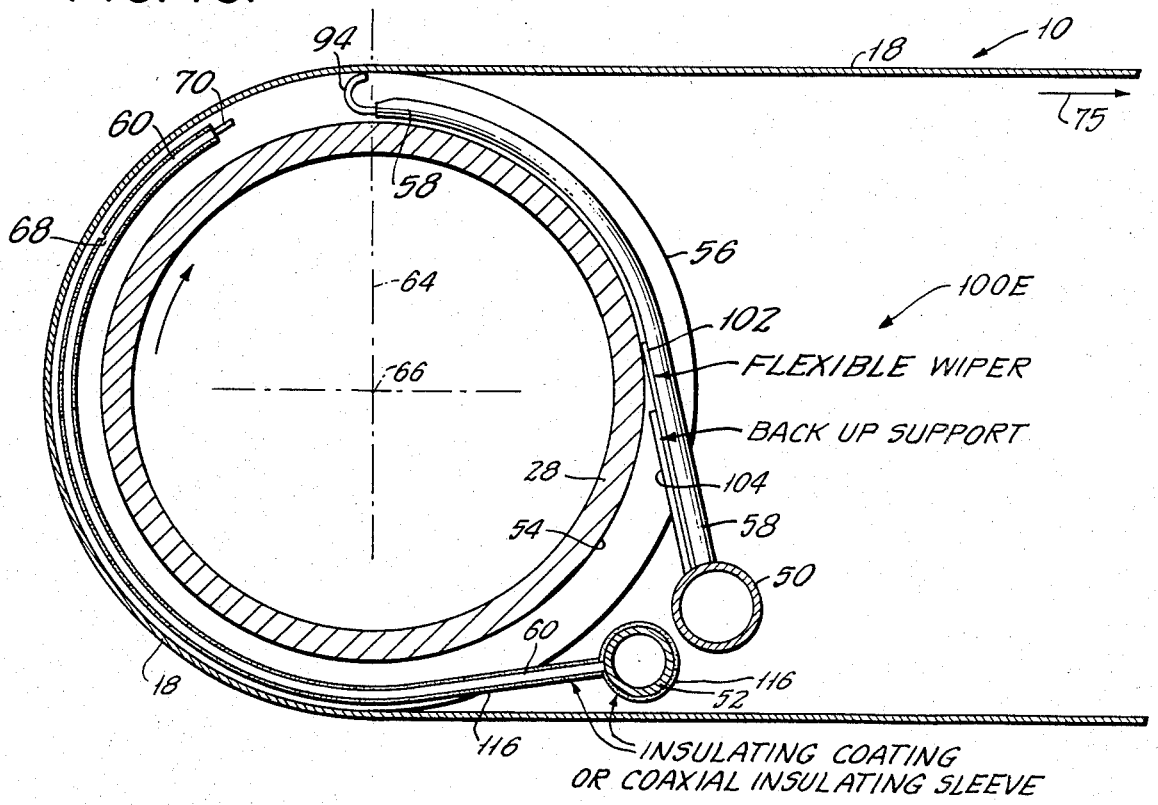
FIG. 16 shows another embodiment of a flexible wipe shield arrangement for the hook nozzle embodiment of FIG. 8.

The wiper arrangements 100D and 100E of FIGS. 15 and 16 may be employed in twin-belt machines utilizing the reverse-wrap nip nozzles having a hook nozzle configuration as shown in FIG. 8, and also can be utilized in wheel-belt machines having a similar reverse-wrap tube and hook nozzle coolant applying arrangement as shown in FIG. 9. In this particular type of installation it is extremely difficult to remove coolant from the deep circumferential grooves 54 which have these reverse-wrap nip tubes 58 nested in them once the water has entered the grooves beneath these tubes. Therefore, a shield arrangement 100D with long flexible blades 102 is provided with rigid backup supports 104 which extends up past and underneath the hooked nozzles 94. The blades 102 are flexible or molded components such as used for the set of finger wipers for scraping the sides of the nip pulley fins 56 as described above in FIGS. 10–14. This wiper shield arrangement 100D employs the stiffened backup support 104 because the shield must be reasonably rigid to avoid deflection such as would cause any disturbance of the nip water pattern or application of the jets of the water emanating from the hook nozzles 94. There are also rigid shields or deflectors 119 which keep the coolant away from the steam header and tubes 52 and 60.

Another wiper arrangement 100E is shown in FIG. 16 in which the wiper shield comprising the flexible set of blades 102 and the rigid backup support 104 are attached to the underside of the reverse-wrap coolant feed tubes 58 in order to remove water from the grooves 54 and to shield the steam header 52 and steam tubes 60. In addition, a thermal insulating coating 116 is shown applied to the steam header and tubes to prevent or at least reduce heat loss to the steam. In place of the insulating coating 116 a coaxial insulating sleeve and steam tube assembly may be provided, where the inner tube carrying the steam is placed inside of another insulating tube or sleeve.

Although a second set of radial steam discharge ports 68' is shown in certain FIGURES, it is our present preference to employ only one set of such discharge ports 68 as shown by the plotted curves 77, 79 and 91 in FIG. 6.

In the production installation in which a twin-belt caster was equipped with the two-stage steam preheating system and coolant system as shown in FIGS. 3, 4 and 5 there were dramatic improvements. Prior to such steam preheating the installation required acetylene burners running continuously and trained onto the front surfaces of both belts for providing soot coatings in order to continuously cast aluminum slabs of commercially acceptable quality. The average production rate was 23 feet per minute (fpm); and the fastest rate at which this installation had ever been run for producing commercially acceptable aluminum slabs was 27 fpm.

Without two-stage steam belt preheating in accordance with the present invention, it was consistently found that the outboard surface of the cast slab 15 issuing from this twin-belt caster was up to 60° F. hotter than the inboard or center surface of this slab, the center always being the coolest. With the steam applied in accordance with the present invention, temperatures on the slab 15 were more symmetrical with the inboard and outboard surfaces of the issuing slab being approximately the same temperature and the center somewhat cooler. The use of the two-stage steam belt preheating in accordance with the present invention allows for thinner belt coatings which enable the casting machine to cast faster as well as improving the surfaces of the cast slab. The belt preheating in accordance with the present invention keeps the belts from distorting and losing contact with the surface of the slab as it is solidifying, thereby improving those surfaces.

Using the two-stage steam belt preheating method and apparatus as shown in FIGS. 3, 4 and 5 and with such preheating applied only to the lower belt at a steam header pressure (saturated steam) of 15 p.s.i. above atmosphere a commercially acceptable slab was cast at 25 fpm without use of any acetylene burners for either belt.

Using two-stage steam preheating for both belts in this same installation a commercially acceptable slab was cast at 25 fpm without use of any acetylene burners for either belt so long as the saturated steam pressure in the steam supply header at 71 was at 10 psig (above atmosphere) or higher.

For both of the above tests the insulative coating on the front faces of both belts was relatively thick.

Further tests were run on this installation using thinner insulative coatings on the front faces of both belts and with the acetylene burners running for forming a thin soot coating on the front faces of both belts. The installation was able to run all day at 29.5 fpm while producing commercially acceptable slabs. This rate was the maximum speed possible for the given machine drive.

The machine drive was changed to enable a faster speed and the caster was able to run at 31 fpm while producing a commercially acceptable aluminum slab superior to that normally produced in this installation.

Other tests were also run at this installation which confirmed to our complete satisfaction that this invention is truly extremely beneficial. For example, changes were made, such as by turning off the steam preheating, and cracks or sinks almost immediately appeared in the cast slab. The foregong sets forth the highlights of these tests.

The wiper shield arrangements as shown in FIGS. 10–14 were not employed in these tests, and we believe that further improvements will result from their usage.

The two-stage steam preheating enabled the same pair of casting belts to be used for more than two weeks of steady full-day production.

The aluminum material being cast was aluminum alloy No. 3105 modified. Its composition limits are:

| ALUMINUM ALLOW LIMITS | |
|---|---|
| ELEMENT | % LIMITS |
| Silicon (Si) | .35 max. |
| Iron (Fe) | .90 max. |
| Copper (Cu) | .22 max. |
| Manganese (Mn) | .70 to .80 |
| Magnesium (Mg) | .25 to .35 |
| Zinc (Cn) | .35 max |
| Chromium (Cr) | .10 max. |
| Titanium (Ti) | .15 max |
| Also: % Mn + Mg = 1.0% to 1.20% max. | |
| Aluminum (Al) | Balance |

Figure 8A:
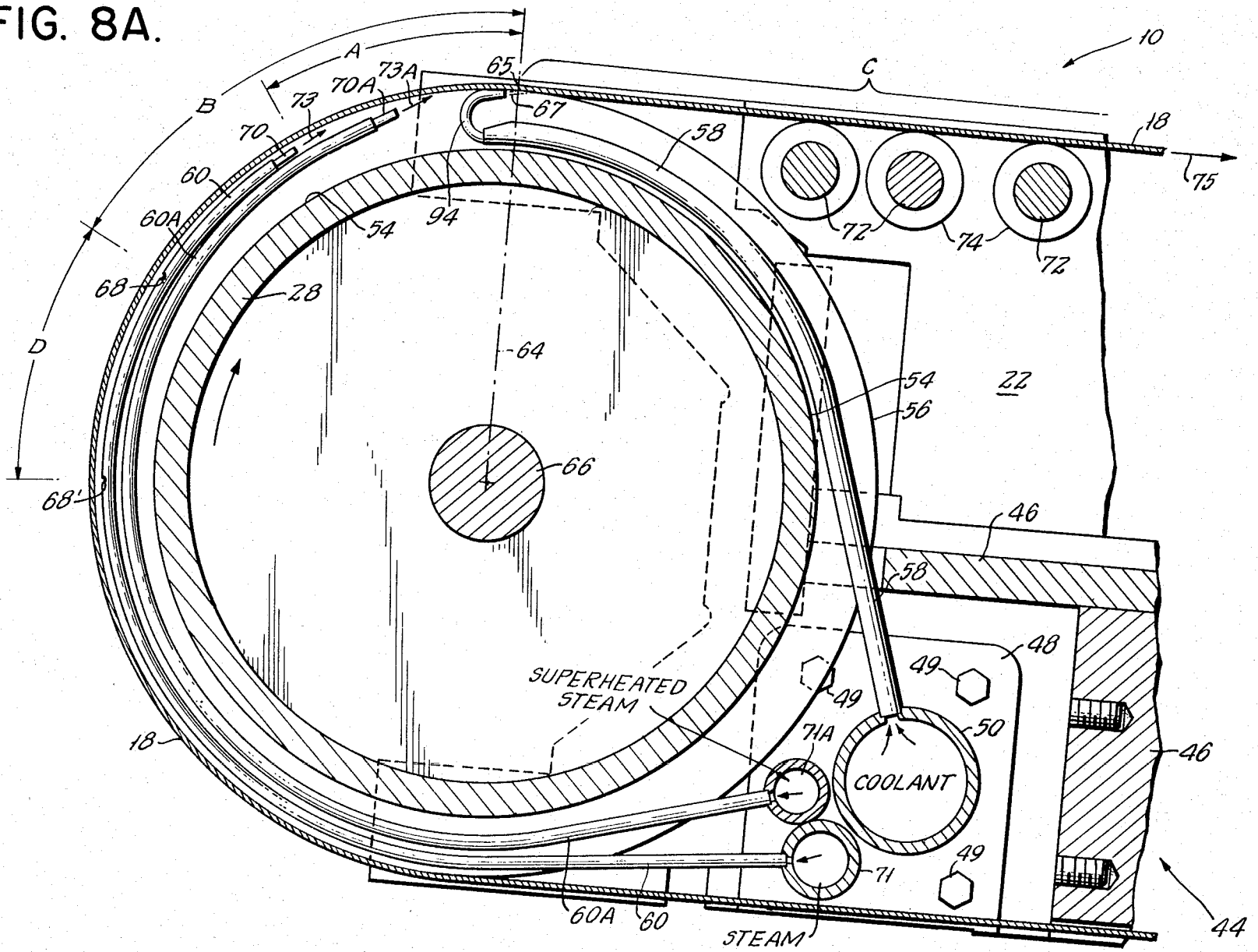
FIG. 8A is similar to FIG. 8, except it shows twin steam tubes, one with saturated steam and one with superheated steam.

FIG. 8A illustrates a modification of FIG. 8 wherein twin steam feed tubes 60 and 60A are used to preheat the belt. Tube 60 directs saturated steam toward the rear surface of the belt 18 to preheat the Belt to a temperature close to saturated steam temperature. Feed tube 60A having a nozzle 70A which directs high temperature superheated steam 73A from a source 71A in an intense final thermal "kick" to preheat the belt 18 to a temperature substantially above saturation temperature, just before the belt enters the mold region.

Since other changes and modifications varied to fit particular operating requirements and environments will be apparent to those skilled in the art, the invention is not considered limited to the examples chosen for purposes of illustration, and covers all changes and modifications which do not constitute a departure from the true spirit and scope of this invention as claimed in the following claims and reasonable equivalents of the claimed elements.

What is claimed is:

1. In the continuous casting of molten metal wherein the molten metal is contained and moved along in a casting zone having an input end and an output end by at least one thin, flexible endless casting belt, said output end of said casting zone being downstream from said input end of said casting zone, said casting belt having a front surface carrying said molten metal in said casting zone and having a reverse surface and wherein the casting belt travels partially around curved guide means adjacent to the input end of the casting zone with the reverse surface of the belt being curved concave where the belt travels around said guide means, the improved method of preheating the casting belt before it reaches the input end of the casting zone comprising the steps of:

providing said guide means with deep circumferential grooves adjacent to said curved reverse surface of the casting belt, conducting steam along confining passages within said deep grooves, impinging first jets of steam directed radially outwardly from said confining passages in said deep grooves against the reverse surface of the belt for producing a first stage of elevation of the belt temperature before the belt reaches said input end of said casting zone, said first jets of steam being located upstream of the input end of the casting zone by an angular distance of at least 45° defined by the arc of a 45 degree angle as measured from said first jets to the input end of said casting zone with an axis of curvature of said guide means defining the apex of said angle, impinging second jets of steam aimed downstream from said confining passages in said deep grooves contacting the reverse surface of the belt with the steam in said second jets travelling downstream for producing a second stage of elevation of the belt temperature following said first stage of elevation of the belt temperature in front of the position where the belt reaches said input end of said casting zone and for creating a downstream flow of steam in said deep grooves travelling downstream toward the input end of said casting zone, said second jets of steam being angularly spaced downstream by a second angular distance of at least 20° from said first jets, conducting coolant liquid along other confining passages within said deep grooves, and impinging jets of liquid coolant aimed downstream from said deep grooves striking the reverse surface of the belt at an angle of incidence less than 25° near to the input end of the casting zone and travelling downstream along the reverse surface of the belt as the belt enters the casting zone.

2. In the continuous casting of molten metal, the improved method of preheating the casting belt as claimed in claim 1 further comprising:

directing said first jets of steam radially outwardly impinging perpendicularly against the reverse surface of the casting belt for producing a sudden increase in temperature.

3. In the continuous casting of molten metal, the improved method of preheating the casting belt as claimed in claim 2 further comprising:

directing said second jets of steam at an angle of incidence of less than 10° toward the reverse surface of the casting belt with the steam travelling along near the reverse surface of the belt in a direction generally toward the casting zone.

4. In the continuous casting of molten metal, the improved method of preheating the casting belt as claimed in claim 1 including the steps of:

providing a significantly greater volume of steam in said second jets than in said first jets for boosting the belt temperature to a higher temperature level during the second stage of preheating than during the first stage.

5. In the continuous casting of molten metal, the improved method of preheating the casting belt as claimed in claim 1, in which:

said first angular distance is in the range of 45° to 90°.

6. In the continuous casting of molten metal, the improved method of preheating the casting belt as claimed in claim 5, in which:

said second jets of steam are angularly spaced by a second angular distance in front of the input to the casting zone, said second angular distance being in the range of 20° to 45°.

7. In the continuous casting of molten metal, the improved method of preheating the casting belt as claimed in claim 1, further comprising:

supplying said steam at a pressure of at least 5 p.s.i. above atmospheric pressure.

8. In the continuous casting of molten metal, the improved method of preheating the casting belt as claimed in claim 7, further comprising:

superheating said steam to a temperature in the range from 200° F. to 600° F. above the temperature of saturated steam at said supply pressure.

9. In the continuous casting of molten metal, the improved method of preheating the casting belt as claimed in claim 1 including the steps of:

impinging additional jets of steam directed outwardly from said deep grooves against the reverse surface of the belt for producing an initial stage of elevation of the belt temperature ahead of said first jets, said additional jets of steam being located upstream from said first jets by an angular distance of at least 20°.

10. In the continuous casting of molten metal, the improved method of preheating the casting belt as claimed in claim 5, including the step of:

supplying said steam at a pressure of at least 5 p.s.i. above atmospheric pressure.

11. In the continuous casting of molten metal, the improved method of preheating the casting belt as claimed in claim 1, including the steps of:

wiping the liquid coolant from said deep grooves, and keeping the wipe-removed coolant away from cooling relationship with respect to the steam supply.

12. In the continuous casting of molten metal, the improved method of preheating the casting belt as claimed in claim 1, wherein said curved guide means is a pulley rotating about its axis of curvature, said pulley having said deep circumferential grooves, and including the further steps of:

conducting coolant water along confined passages within said deep grooves on the opposite side of the pulley axis from the steam, providing hook-shaped means for suddenly reversing the direction of coolant flow in a position in said deep grooves slightly ahead of the input end of the casting zone, and discharging the suddenly-reversed coolant in a direction toward the reverse surface of the casting belt for impinging against said reverse surface close to the input end of said casting zone of said angle of incidence less than 25° and flowing along the reverse surface of the belt toward the casting zone.

13. In the continuous casting of molten metal, the improved method of preheating the casting belt as claimed in claim 12, including the step of:

supplying said steam at a supply pressure of at least 5 p.s.i. above atmospheric pressure.

14. In the continuous casting of molten metal, the improved method of preheating the casting belt as claimed in claim 12, including the steps of:

wiping the liquid coolant from said deep grooves, and channeling the wipe-removed coolant away from cooling relationship with respect to the supply steam.

15. In a machine for continuously casting molten metal wherein at least one thin, endless, flexible casting belt having a front face and a reverse face revolves around pulleys and passes along a casting zone having an input end and an output end, said output end of the casting zone being downstream from said input end, said belt moving along said casting zone from the input end to the output end of the casting zone for carrying the metal being cast against the front face of the casting belt through said casting zone, apparatus for preheating said casting belt with steam comprising:

an input pulley for moving said casting belt into the input end of said casting zone, said input pulley having circumferential grooves therein underlying the reverse face of said casting belt as said casting belt revolves partially around said input pulley in moving toward and into the input end of the casting zone, wrap-around steam feed tubes each having a nozzle on the end thereof, said steam feed tubes and nozzles being positioned in the respective circumferential grooves of said input pulley, said steam feed tubes each having radial steam ports aimed toward the reverse face of the casting belt for applying steam from said radial ports to the reverse face of said endless belt near to the input end of the casting zone for preheating said belt before said belt enters the input end of said casting zone, said radial steam ports being located upstream of the input end of the casting zone by a first angular distance of at least 45° defined by an angular arc as measured from said first jets to the input end of said casting zone with an axis of rotation of said input pulley defining the apex of said angle, said nozzles being located downstream from said radial ports by a second angular distance of at least 20° from said radial ports, said second angular distance being defined by an angular arc as measured from said radial ports with said axis of rotation defining the apex thereof, and said nozzles being aimed downstream for applying steam travelling downstream from said nozzles impinging against the reverse face of the belt nearer to the input end of the casting region than said radial ports for producing a second stage of preheating said belt before the belt reaches said input end of the casting zone, said two stages of steam preheating reducing belt distortion caused by the tremendous heating effect of the molten metal for thereby enabling the speed of the casting machine to be increased.

16. In a machine for continuously casting molten metal, the apparatus as claimed in claim 15 in which:

each of said wrap-around steam feed tubes has a radial port positioned to direct steam toward the reverse face of said endless belt, each such port being spaced from the respective nozzle on the respective steam feed tube.

17. In a machine for continuously casting molten metal, the apparatus as claimed in claim 15 including:

wrap-around liquid coolant feed tubes one of which is positioned in each of said circumferential grooves with a wrap-around steam feed tube, said wrap-around liquid coolant feed tubes each having a nozzle positioned to direct a steam of liquid coolant on the reverse face of said endless belt near the location where said endless belt enters the input end of said casting zone.

18. In a machine for continuously casting molten metal, the apparatus as claimed in claim 15 including:

wrap-around liquid coolant feed tubes one of which is juxtapositioned in each of said circumferential grooves of said input pulley with a steam feed tube, each of said coolant feed tubes having a nozzle which is positioned ahead of the nozzle of the juxtapositioned steam feed tube in the respective circumferential grooves, whereby said steam feed tubes preheat said belt prior to its entry into said casting zone and said liquid coolant feed tubes cool said endless belt as it enters said casting zone and comes into contact with the molten metal.

19. In a machine for casting molten metal, the apparatus as claimed in claim 15 having:

a reverse-wrap liquid coolant feed tube positioned in each of said circumferential grooves of said input pulley, each of said reverse-wrap coolant feed tubes having a hook nozzle on the end thereof for suddenly reversing the direction of the coolant prior to issuing from said hook nozzle for impinging on the reverse face of said endless belt near the input end of said casting zone and flowing in a direction generally toward said casting zone.

20. In a machine for casting molten metal, the apparatus as claimed in claim 17, having:

a flexible, bladed wiper shield positioned in and conforming to the configuration of said circumferential grooves, for wiping liquid coolant away from said circumferential grooves and for preventing the removed coolant from coming into contact with said steam tubes.

21. In a machine for casting molten metal, the apparatus as claimed in claim 17, having:

a steam supply header and a coolant supply header, said coolant feed tubes being connected to said coolant header and said steam feed tubes being connected to said steam header.

22. In a machine for continuously casting molten metal, the apparatus as claimed in claim 16, in which:

each of said radial ports is positioned at an angular distance at least 20° upstream of the nozzle on the respective steam feed tube.

23. In a machine for continuously casting molten metal, the apparatus as claimed in claim 16, in which:

each of said radial ports is positioned at a first angular distance from the input end of the casting zone in the range of 45° to 90°.

24. In a machine for continuously casting molten metal, the apparatus as claimed in claim 21, having:

a flexible wiper shield conforming with the configuration of said circumferential grooves and being positioned in said circumferential grooves and overlying said steam header for preventing coolant from falling directly on said steam header as well as wiping coolant away from said circumferential grooves.

25. In a machine for continuously casting molten metal, the apparatus as claimed in claim 24 in which:

said wiper shield comprises a one-piece stiffly flexible molded scrapper.

26. In a machine for continuously casting molten metal, the apparatus as claimed in claim 24 in which:

said wiper shield has a rigid back-up support, and an air supply is directed on said wiper shield and into said grooves for assisting said wiper shield in removing coolant from said grooves.

27. In a machine for continuously casting molten metal, the apparatus as claimed in claim 26 having:

a second wiper shield extending into said grooves below said other wiper shield and said air supply, thereby providing a confined region between said shield for said air supply for requiring less air to assist in removal of coolant from said grooves.

28. In a machine for continuously casting molten metal, the apparatus as claimed in claim 19 having:

a wiper shield extending into and conforming with the shape of said circumferential grooves in said input pulley, said wiper shield being finger-shaped with the fingers thereof extending under and beyond the end of the respective hook nozzles.

29. In a machine for continuously casting molten metal, the apparatus as claimed in claim 19 having:

a steam supply header to which said steam feed tubes are connected and a coolant supply header to which said liquid coolant feed tubes are connected, a wiper shield positioned on the underside of said liquid coolant feed tubes but overlying said steam header for removing coolant from said grooves and for preventing coolant from falling directly onto said steam header or steam feed tubes.

* * * * *